US007753328B1

(12) United States Patent
DeMeyers

(10) Patent No.: US 7,753,328 B1
(45) Date of Patent: Jul. 13, 2010

(54) MOUNTING SYSTEM FOR A FRAME

(76) Inventor: Greg Scott DeMeyers, 303 Starling La., Franklin, TN (US) 37064

( * ) Notice: Subject to any disclaimer, the term of this patent is extended or adjusted under 35 U.S.C. 154(b) by 249 days.

(21) Appl. No.: 12/080,876

(22) Filed: Apr. 7, 2008

Related U.S. Application Data

(60) Provisional application No. 60/917,221, filed on May 10, 2007.

(51) Int. Cl.
*A47H 1/10* (2006.01)

(52) U.S. Cl. ..... 248/261

(58) Field of Classification Search ..... 248/251, 248/252, 261, 262, 316.8
See application file for complete search history.

(56) References Cited

U.S. PATENT DOCUMENTS 1,350,221 A * 8/1920 Griffin ..... 248/252
2,019,789 A 11/1935 Mahannah
3,049,327 A * 8/1962 Caudell ..... 248/220.1
3,204,908 A 9/1965 Brown
3,889,912 A * 6/1975 Ray ..... 248/255
4,616,797 A 10/1986 Cramer
4,702,448 A 10/1987 LoJacono et al.
4,903,929 A 2/1990 Hoffman
4,961,296 A 10/1990 Morehouse
5,544,692 A 8/1996 McMichael
5,673,741 A 10/1997 Cairns
5,810,302 A 9/1998 McCance

* cited by examiner

*Primary Examiner*—J. Allen Shriver, II
*Assistant Examiner*—Erin Smith
(74) *Attorney, Agent, or Firm*—Waddey & Patterson, P.C.; Ryan D. Levy

(57) ABSTRACT

A mounting system for providing, inter alia, an attachment point for hanging about a frame.

21 Claims, 2 Drawing Sheets

MOUNTING SYSTEM FOR A FRAME

CROSS-REFERENCES TO RELATED APPLICATIONS

This application is a utility application which claims benefit of Provisional Patent Application Ser. No. 60/917,221 filed May 10, 2007, entitled "A Wall Mount System that Utilizes Existing Window or Door Frames" which is hereby incorporated by reference.

BACKGROUND OF THE INVENTION

Technical Field

The present invention relates to a wall mounting system useful for applications including the hanging of a curtain rod, a window treatment or other objects. More particularly, the present invention relates to a mounting system that utilizes a frame, including door and window frames, and grasps both a vertical edge and horizontal edge of the frame to secure the mounting system in place. The invention also includes a method of providing an attachment point for hanging through the use of the inventive mounting system.

BACKGROUND ART

Mounting systems attract considerable attention because of their capacity to hang curtain rods or window treatments in decorating or covering a window, door or other framed area. Conventionally, mounting systems are affixed to either the surface of a frame or to the wall itself with nails, screws, or other attachments so that the base portion of the mounting system is securely attached. Other embodiments of prior art mounting systems for hanging window treatments or curtain rods include nonpermanent attachments which result in less damage to the wall or frame. As both types of mounting systems have advantages and disadvantages, a variety of different mounting systems have been developed for use with in hanging or attaching various objects including curtains and window treatments. For example, in Mahannah, U.S. Pat. No. 2,019,789, an adjustable support for a clamp is disclosed to secure a rod or other metallic element within the clamp. According to Mahannah, the adjustable support may include an adjustable length and is ideally suited for clamping about the edge of a work bench.

In Brown (U.S. Pat. No. 3,204,908), a line holder is disclosed which may be attached by clamping or securing means over an extended edge. Generally the clamping means comprise bolts or screws, including set screws, so that the clamp is securely attached to an edge.

In U.S. Pat. No. 4,616,797, Cramer disclosed an adjustable support assembly which may be releasably secured to an elongated support member such as a pole. Allegedly, the '797 patent provides an infinitely adjustable support assembly that may be used to support medical equipment as well as other items through the use of a clamp body member which fits about the pole.

LoJacono et al (U.S. Pat. No. 4,702,448) discloses an adjustable support bracket including a crescent shape opening for attaching to a rod. Generally, the '448 patent discloses a clamp body including an opening specifically designed to receive various types of mounting structures.

In U.S. Pat. No. 4,903,929, Hoffman disclosed a holding device designed to clamp onto a wide variety of fixtures. The clamp generally comprises a 'C' clamp coupled to a retainer so that a type of object may be retained while the clamp is securely affixed to a structure.

Morehouse (U.S. Pat. No. 4,961,296) discloses a rod hanger capable of being affixed to the frame of a window or door in a manner preserving the appearance of the frame. The patentee points out that the curtain rod hanger of the '296 patent can be installed without nails or screws and generally requires the insertion of a hanger between the wall and the window frame for the securing of a curtain rod. Otherwise stated, the '296 patent is suited for use in a wall/window frame environment where the wall and frame edge piece are spaced slightly apart so that a gap exist there between.

In U.S. Pat. No. 5,544,692, issued to McMichael, curtain draping hardware is disclosed with U-shape portions to provide for arcs or tails on one or both sides of the curtain in creating a decorative arrangement. Most often the attachments as disclosed within the '692 patent include hooks, clamps, tape, glue, Velcro, or other methods useful for attaching items together.

Cairns, U.S. Pat. No. 5,673,741, discloses a telescoping curtain rod with an attachment surface which either describes a permanent or semi-permanent surface which matingly attaches to draperies and allows for the easy attachment and removal of draperies from the curtain rod. Generally, the '741 patent discloses a curtain rod with an outer frame and an inner frame, with the inner frame slidingly mounted within the outer frame with one or more attachment surfaces for attaching a drapery thereto.

In U.S. Pat. No. 5,810,302, issued to McCance, a curtain rod assembly is disclosed having an adjustable length as well as griping pads arranged in a design to exert a force between two opposed window jam surfaces to support the adjustable length compression rod there between. In further embodiments, McCance discloses a pair of attachment apertures at each end of the curtain rod for the attachment of shade assembly or blind assembly thereto.

Unfortunately mounting systems for window treatments as disclosed within the prior art are generally not effective in providing a mounting system which may be easily installed with little to no marring or permanent deformation of the wall or frame. The existing mounting systems generally requires screws or clamp type designs about parallel edges and furthermore fail to provide the adjustability for a consumer to place a window treatment, curtain or other object exactly where they want the treatment but without the effort of drilling into the wall or frame. Furthermore, many of the prior art systems would not likely provide the support and/or security needed to hold heavy curtain arrangements. In multiple prior art systems, the systems interfere with one's ability to open and close the window completely, typically where a compression rod is utilized. In addition, most mounting systems are difficult to remove from the wall or frame once installed into the structure.

What is desired therefore is a mounting system which provides a mounting point for a hook or other hardware without requiring drilling, or screwing into the wall or frame. Indeed a combination of characteristics including the capacity to be removed and reused without leaving holes or marred/damaged visible surfaces are desired for a wide variety of applications. Also desired, is a method of mounting the mount for providing an attachment point without leaving holes or a damaged visible surface.

BRIEF SUMMARY OF THE INVENTION

The present invention provides a mounting system that may utilize an existing frame, including both window and door frames, which is uniquely capable of use in applications involving the hanging of a window treatment, curtain or other object. The inventive mounting system exhibits a nonpermanent attachment as well as an ease of installation to provide a combination of characteristics not heretofore seen. In addition, the grasping nature of the mounting system with a first brace and a second brace and linkage there between provides a mounting system which can either be temporarily or permanently mounted while leaving minimal markings on the either the wall or frame. More particularly, the invention of the present application includes a first brace, a second brace, a linkage, and a securement connection. Generally, the first mounting brace is attached to the second mounting brace via the linkage and a securement connection further connects the first and second brace in providing the mount system of the present invention. Most often, the securement connection is adjustable to provide tension in connecting the mounting system to a frame.

In further embodiments, the mounting system of the present application may include an attachment for a mounting hook, or an affixed mounting hook, which may be utilized for a curtain rod, window treatment or other object. The mounting system of the present invention may be comprised of a variety of materials including, but not limited to, plastics, aluminums, steel, alloys, metals, polymers or combinations thereof. Generally, any sufficiently resilient and at least semi-rigid material may be utilized in comprising the major components of the mounting system of the present application. Preferably in embodiments containing cushions under the braces, the cushions may be comprised of materials having a sufficient compression so that the frame is protected.

The linkage of the wall mounting system is preferably attached to the first brace and second brace to allow for movement of the linkage during the adjustment of the securement connection and may include attachment to the braces via soldering, screws, welding, nuts and bolts, rivets, friction fit, or combinations thereof.

Advantageously, to attach the mounting system, the mounting system is placed about a corner of a frame with the first brace on one edge of the frame and the second brace engaging a second edge of the frame. Subsequently, the securement connection may be tightened to apply force to both the first brace and the second brace and securely engage the mounting system to the frame.

An object of the invention therefore is a mounting system for a frame having characteristics which enable it to be employed in either a permanent or removable application.

Another object of the invention is a mounting system which leaves little to no visible markings on or about the wall or frame.

Still another object of the invention is a mounting system having adjustability for a variety of different styled frames.

Another object of the invention is a mounting system which can be easily adjusted to provide the user a variety of options in attaching a window treatment, curtain or other object.

Another object of the invention is a method of installing the mounting system.

These aspects and others that become apparent to the artisan upon review of the following description can be accomplished by providing a mounting system formed of a first brace and a second brace connected by a linkage and a securement connection where the mounting system leaves little to no visible markings on either the frame or the wall. The inventive mounting system advantageously allows for both a permanent and removable attachment, and furthermore, may be applied with minimal tools and significant ease.

It is to be understood that both the foregoing general description and the following detailed description provide embodiments of the invention and are intended to provide an overview of framework of understanding to nature and character of the invention as it is claimed.

DETAILED DESCRIPTION OF THE PREFERRED EMBODIMENTS

Figure 1:
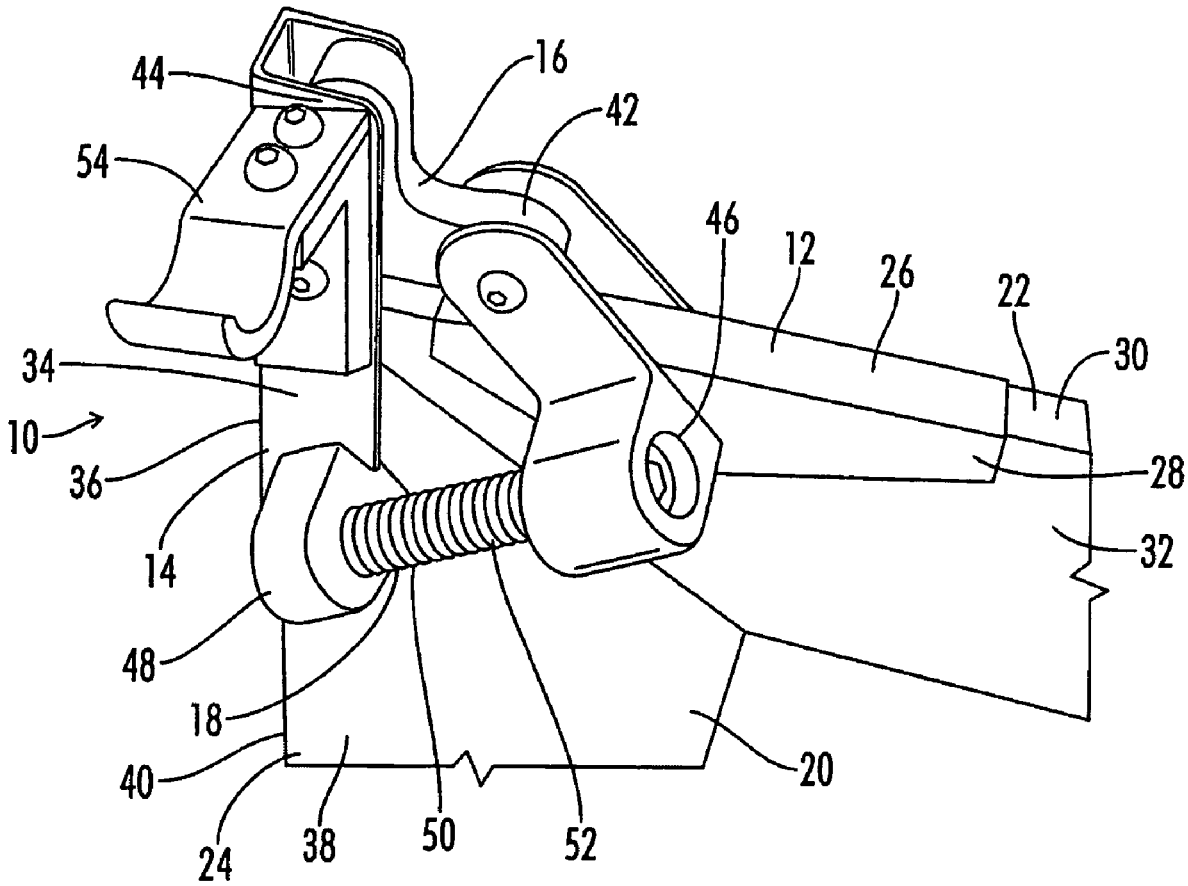
FIG. 1 is a view of a first embodiment of the mounting system of the present invention.

Referring now to FIG. 1, there is at 10, a mounting system in accordance with the invention of the present application. Generally, wall mounting 10 includes first brace 12, second brace 14, linkage 16, and securement connection 18. In describing mounting system 10, mounting system 10 is mounted on frame 20 having first edge 22 and second edge 24.

First brace 12 is connected to second brace 14 by both linkage 16 and securement connection 18 with linkage 16 connecting each brace near to an end of first brace 12 and second brace 14 with the securement connection 18 connecting each brace distally from linkage 16.

In a preferably arrangement, mounting system 10 is utilized with a frame having about a 90° corner between first edge 22 and second edge 24 resulting in first brace 12 arranged about perpendicular to second brace 14, though mounting system 10 may be utilized with either obtuse or acute angle framed corners.

More specifically, first brace 12 includes top face 26 and front face 28 corresponding to top surface 30 and front surface 32 of frame edge 22. Generally, top face 26 and front face 28 of first brace 12 are designed to fit about flush to top surface 30 and face surface 32 of frame edge 22. Additionally, the underside (not shown) of top face 26 of first brace 12 may include small teeth, points, or other griping type features to better engage top surface 30 of frame 22. Advantageously, if marks are created by the small teeth or gripping features of the underside of top face 26 such markings or indentions would typically be non-visible to a viewer as they exist on top surface 30 and not face surface 32 of window frame 20.

Second brace 14 includes front face 34 and side face 36 in fitting about flush with face surface 38 and side surface 40 of second edge 24 of window frame 20. Similar to first brace 12, the underside of side face 36 may include small teeth indentations or other gripping means to better engage side surface 40 of second edge 24 of window frame 20. Additionally, this orientation of teeth on the underside of side face 36 would not leave any marring on face surface 38 of window frame 20.

Linkage 16 connects first brace 12 to second brace 14 by first connection 42 and second connection 44. Preferably, first connection 42 and second connection 44 are movably connected via nuts and bolts, rivets, friction fits, or other connectors to provide for at least a slight degree of movement at each connection. Movement at both first connection 42 and second connection 44 is preferable, so that first brace 12 and second brace 14 of mounting system 10 do not rotate off of window frame 20 during the tightening of the mounting system. However, further embodiments of first connection 42 and second connection 44 may also include welds, screws, and soldering. This style of connection may require more care in attaching this type of mounting system. Furthermore, with first connection 42 and second connection 44 providing for at least a slight degree of movement, a variety of different angled corners may be used as first brace 12 and second brace 14 would not necessarily be in a fixed permanent perpendicular arrangement.

Securement attachment 18 generally comprises first securement connection point 46, second securement connection point 48, and screw 50. Preferably, first securement connection point 46 and second securement connection point 48 are respectively attached to front face 28 and front face 34 of each of the braces of mounting system 10. Additionally, either one or both of securement connection points is opened so that screw 50 maybe rotated to pull first brace 12 toward second brace 14. Otherwise stated, when screw 50 is tightened, force is applied to pull front face 28 closer to front face 34 thus causing top face 26 and side face 36 to further engage top surface 30 and side surface 40 of frame 20. Screw 50 may include the head design for an Allen wrench, Phillips screwdriver, socket wrench, or flat screwdriver as well as may include a variety of other designs so that a user may be able to rotate screw 50 and best tighten mounting system 10. Additionally, compressible element 52 may be situated around screw 50 to assist in maintaining stability between first brace 12 and second brace 14 while installing mounting system 10. Generally, the compressible element 52 may comprise a spring where further embodiments may include a rubber or polymeric sheath or even a metallic or semi metallic sheath about screw 50.

Mounting hook 54 as embodied in FIG. 1 is one type of hardware which may be attached to front face 34 of second brace 14 via attachment point 56. Additionally, hook attachment 54 may be removably attachable so that a user could alter the style of hook dependent on what was being hung from mounting system 10 though can be permanently attached to provide even greater strength. Typically, hook 54 may be contoured for a curtain rod, window treatment or other object. In further embodiments (not illustrated), hook 54 is not included and thus attachment point 56 is left open. Advantageously, this allows a user to utilize existing hardware as a user so desires to secure to the mounting system. As a variety of attachments for window treatments or objects may vary, the user could simply attach the hardware to attachment 54 on front face 34 of second brace 14 of mounting system 10 to hang their intended object.

While in preferable embodiments, mounting system 10 is utilized for hanging curtain rods or window treatments, mounting system 10 may be utilized about any frame having a face surface and multiple edges which are not in a parallel arrangement. Yet furthermore, the mounting system of the present invention may be used to mount a variety of objects to a wall, window, or other type frame including a door frame. Additionally, the mounting system may be used to provide a mounting point to hang banners, decorations, balloons, beaded curtains, blinds, or various other window treatments. In further embodiments, the mounting system may also be utilized to hang a closet rod to provide space for hanging clothes, towels, and various other apparel related items and can be even used to provide a mounting port for hanging various types of room dividing materials. Alternatively, the mounting system may also be utilized to provide a mounting point for hanging items such as car keys, dog leashes, coats, shoes, hats, gloves and the like. In various other settings, the mounting system may be used as a mounting point for storing hanging items such as plastic bags, tools, bikes, as well as other items which may be typically mounted to a wall for storage.

Figure 2:
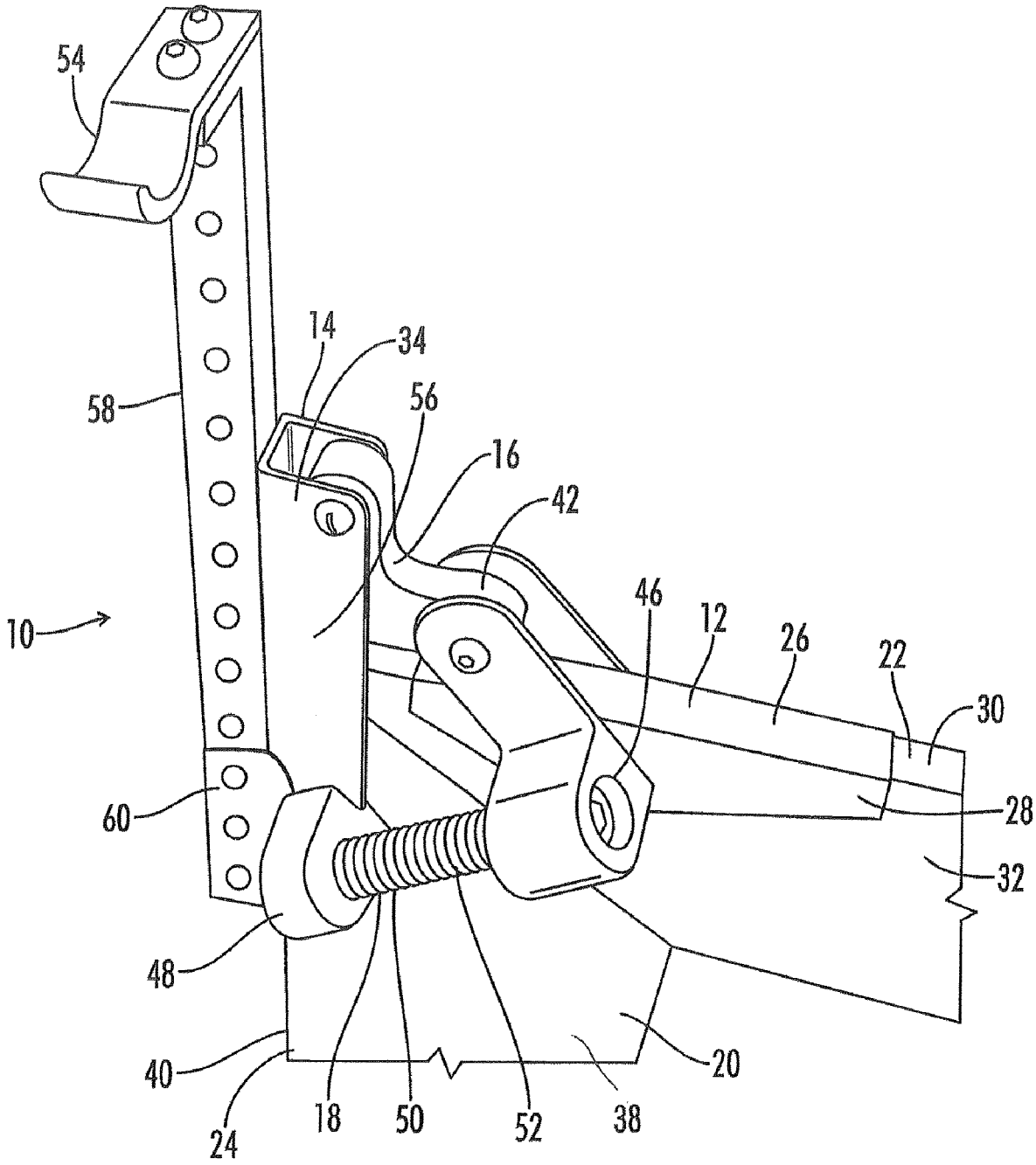
FIG. 2 is a view of a second embodiment of the mounting system of the present invention.

Now referring to FIG. 2, there is a further embodiment of mounting system 10 with extension rod 58 attached via mounting bracket 60. Generally, extension rod 58 may be moved up or down to the desired height of where the items should be hung relative to mounting system 10. Extension rod 58 may move by removing a small screw or screws which connects extension rod 58 to attachment bracket 60 and thus replacing the screw or screws in the desired hole of extension rod 60 once the extension rod has been moved to the desired height. Generally, the screw may be fit with the Allen wrench style head, Phillips head, flat head or may include the design for a socket wrench system. In further embodiments, extension rod 58 may connect to attachment bracket 60 via a peg in hole system to lock the extension rod relative to mounting system 10. The peg may be a screw, bolt, or other locking device. In yet additional embodiments, extension rod 58 could also attach to first brace 12 via multiple types of connections including a male/female type connection to hold the extension rod in place where the extension rod itself could be formed of multiple pieces so that the extension rod could extend or retract upon. Additionally, extension rod 58 may be permanently affixed to mounting system 10 either on second brace 14 or first brace 12 and retract or extend within itself using a variety of locking systems including a peg in a hole type locking system. Yet furthermore, the exterior dimensions of extension rod 58 could also differ in shapes from a square to include a circular tube, triangular tube, hexagonal tube, or various other external arrangements.

In further embodiments of the invention, mounting hook 54 may or may not be included with mounting system 10 so long as an attachment point is included on mounting system 10 for the attachment of additional hardware. Additionally, cushions may be included on the underside of each of first brace 12 and second brace 14 so that the contact sides have even a lesser likelihood of marring or damaging the frame. Generally, the cushion may be comprised of a variety of different materials, including but not limited to rubbers, polymers, plastic, foam, felt, fabrics or any other sufficiently compressible material so as to provide greater protection to the frame to which mounting system 10 attaches.

The mounting system of the present invention is generally comprised of a metal or metal alloy compound but may be comprised of any other sufficiently rigid material. In further embodiments, the major components of mounting system 10 may include plastic, polymers, aluminum, steel, metals, metal alloys or combinations thereof.

Accordingly, by the practice of the present invention, a mounting system having heretofore unrecognized characteristics is disclosed. The mounting system exhibits a less intrusive mounting design as no permanent holes are required for attachment, and furthermore the device leaves little to no visible marks about or on a frame.

The disclosure of all cited patents and publications referred to in this application are incorporated herein and by reference.

The above description is intended to enable the persons skilled in the arts to practice the invention. It is not intended to lead to all the possible variations and modifications that have become apparent to the skilled worker upon reading the description. It is intended however that all such modifications and variations be included within the scope of the invention that is defined by the following claims. The claims are intended to cover the indicated elements and steps in any arrangements or sequence that is effective to meet the objectives intended for the invention, unless the context specifically indicates to the contrary.

What is claimed is:

1. A mounting system for a frame comprising:

a first brace having a front face and a top face for fitting on a first edge of a frame;

a second brace having a front face and a side face for fitting on a second edge of the frame;

a linkage connecting the first brace to the second brace, the linkage comprising a movable connection between the linkage and the first brace to provide for movement of the first brace relative to the second brace;

a securement connection connected to the first brace and the second brace for securing the mounting system to the frame; and wherein the first brace and the second brace do not penetrate between the frame and a wall.

2. The mounting system of claim 1 further comprising the top face of the first brace having an underside with protruding teeth.

3. The mounting system of claim 1 further comprising the side face of the second brace having an underside with protruding teeth.

4. The mounting system of claim 1 further comprising the top face of the first brace having an underside with protruding teeth and the side face of the second brace having an underside with protruding teeth.

5. The mounting system of claim 1 wherein the linkage further comprises a moveable connection between the first brace and the linkage and a movable connection between the second brace and the linkage.

6. The mounting system of claim 1 wherein the securement connection further comprises a first connection point on the front face of the first brace and a second connection point on the front face of the second brace and a screw engaging the first connection point and the second connection point.

7. The mounting system of claim 6 wherein the screw further comprises a head sized for a tool.

8. The mounting system of claim 7 wherein the head of the screw is chosen from a slotted head; a socket head; a cross-head; a square head; a torx head; a spanner head; a double hex head and combinations thereof.

9. The mounting system of claim 6 wherein the securement connection further comprises a compressible element about the screw.

10. The mounting system of claim 9 wherein the compressible element comprises a spring.

11. The mounting system of claim 1 further comprising a hook attached to one of the braces.

12. The mounting system of claim 1 further comprising an attachment point on at least one of the braces.

13. The mounting system of claim 12 further comprising a hook attached to the attachment point on at least one of the braces.

14. The mounting system of claim 1 further comprising an extension rod attached to one of the braces.

15. The mounting system of claim 14 further comprising a bracket for attaching the extension rod to one of the braces.

16. The mounting system of claim 14 wherein the extension rod is adjustable.

17. The mounting system of claim 14 further comprising an attachment point on the extension rod.

18. The mounting system of claim 17 further comprising a hook attached to the attachment point.

19. A mounting system for a frame comprising:

a first brace having a front face and a top face for fitting on a first edge of a frame with the front face fitting on a front surface of the first edge of the frame and the top face fitting on a top surface of the first edge of the frame;

a second brace having a front face and a side face for fitting on a second edge of the frame with the side face fitting on a side surface of the second edge of the frame and the front face fitting on a front surface of the second edge of the frame;

a linkage movably connecting the first brace to the second brace, the linkage comprising a movable connection between the linkage and the first brace and a movable connection between the linkage and the second brace to provide for movement of the first brace relative to the second brace;

a securement connection having a first connection on the front face of the first brace and having a second connection on the front face of the second brace with a screw engaging both the first connection and the second connection for securing the mounting system to the frame; and an extension attached to one of the braces extending in a nonparallel orientation to at least one of the front surface and the top surface.

20. The mounting system of claim 19 further comprising an adjustable extension rod attached to one of the braces.

21. The mounting system of claim 19 further comprising an attachment point for hardware on at least one of the braces.

* * * * *